United States Patent [19]

Whetstone

[11] 4,149,154

[45] Apr. 10, 1979

[54] ALARM BELL AND SYSTEM

[76] Inventor: Robert A. Whetstone, c/o Factory Parts Warehouse, 2505 Farrington, Dallas, Tex. 75207

[21] Appl. No.: 780,981

[22] Filed: Mar. 24, 1977

[51] Int. Cl.[2] ..... G08B 19/00; G08B 3/00

[52] U.S. Cl. ..... 340/521; 340/393; 340/396; 340/593; 340/628; 340/663

[58] Field of Search ..... 340/420, 237 S, 248 B, 340/276, 392, 393, 396, 402, 384 E, 401, 628, 663, 593

[56] References Cited

U.S. PATENT DOCUMENTS

| | | | |
|---|---|---|---|
| 159,369 | 2/1875 | Walter | 340/276 |
| 879,039 | 2/1908 | Dixon | 340/393 |
| 2,609,431 | 9/1952 | Faltz | 340/248 B |
| 2,982,950 | 5/1961 | Boyle | 340/237 SX |

*Primary Examiner*—John W. Caldwell, Sr.

*Assistant Examiner*—Daniel Myer

*Attorney, Agent, or Firm*—Marcus L. Bates

[57] ABSTRACT

An alarm bell especially adapted to be used in combination with a system which simultaneously detects smoke, fire, current failure, and unauthorized entry into an enclosure. The alarm bell has a housing which suports a bell dome. A mechanical motor is contained within the housing and is connected to actuate a first clapper which strikes the dome and sounds an alarm. A second clapper is actuated by an electric motor and is also placed adjacent to the dome. The first clapper cooperates with an electro-magnet such that the magnetic attraction therebetween prevents movement of the first clapper when the electro-magnet is energized. Accordingly, the electro-magnet can be connected to the same source of current which is used to energize the second clapper so that should the source of current fail, the electromagnet will release the first clapper thereby causing the mechanical motor to sound the alarm.

1 Claim, 10 Drawing Figures

ALARM BELL AND SYSTEM

BACKGROUND OF THE INVENTION

Various Governmental Agencies require that new homes have included therein a smoke and fire alarm system, and it is sometimes further required that the alarm system utilize an extraneous or supplemental source of current, so that should the electrical wiring become damaged during a fire, the smoke and fire alarm will remain operative. The extraneous source of current is usually a storage battery. Many conscientious people purchase smoke and fire alarm systems and install the system in their home. After the novelty of enjoying the safeguards brought about by the presence of the alarm system has become familiar, most people generally are inclined to thereafter neglect the system; and accordingly, as time progresses the storage batteries contained within the alarm device become useless, thereby rendering the entire failsafe aspects of the system inoperative.

It is therefore desirable to be able to provide a smoke and fire alarm system which normally utilizes a domestic current source for sounding an alarm, and upon current failure the system utilizes mechanically stored energy to signal the loss of current. It is furthermore desirable that the alarm bell of the present invention include means by which it can also be used as a burglary alarm.

SUMMARY OF THE INVENTION

This invention relates to improvements in alarm systems, and especially, in its more specific embodiment, an alarm bell. The alarm bell of this invention includes a main housing which supports a dome within which there is enclosed a mechanical motor. The mechanical motor stores mechanical energy and is connected to a clapper so that the motor actuates the clapper to strike the dome and sound an alarm.

A second clapper is driven by an electric motor and placed adjacent to the bell dome so tht when the electric motor is energized the second clapper strikes the dome to sound an alarm.

The mechanical motor preserves its potential energy by the provision of an electromagnet which is energized by an extraneous source of current. The electromagnet is placed in close proximity to the first clapper so that the first clapper is attracted thereto and magnetically captured to thereby prevent it from striking the dome so long as the electromagnet is energized.

The employment of a mechanically actuated clapper which is restrained by an electromagnet and the additional use of a second clapper which is actuated by an electric motor enables the second clapper to be normally used to sound an alarm, thereby signifying the danger of fire or smoke, while the first clapper is advantageously used to signify interruption of the source of electrical power for the second clapper.

Accordingly, a primary object of the present invention is the provision of an alarm bell having apparatus associated therewith which causes a first clapper to sound an alarm, and if the source of power for sounding the first clapper should fail, then a second clapper will immediately sound the alarm.

A further object of the present invention is the provision of an alarm bell having a first clapper actuated by mechanical energy and a second clapper actuated by electrical energy, with there being means by which current failure to the source of power for the second clapper causes the first clapper to sound the alarm.

Still another object is the provision of an alarm bell having a clapper actuated by stored mechanical energy and with there being an electrical magnetic coil which preserves the stored energy until current flow therethrough is interrupted.

Another object of the invention is the provision of an alarm system having means of detecting smoke or fire and sounding an alarm in response thereto, and if the current source to the detector should be interrupted, a mechanical alarm is caused to sound.

A further object of the present invention is the provision of an alarm system for detecting smoke, fire, unlawful instrusion, and property theft.

Still another object of the present invention is the provision of an alarm bell having dual clappers thereon with one clapper being energized by a source of electrical current and with the remaining clapper being actuated by stored energy, with there being electrical means for preventing the stored energy from actuating said remaining clapper until the source of electrical current is interrupted.

The above objects are attained in accordance with the present invention by the provision of an apparatus which is fabricated in a manner substantially as described in the above abstract and summary.

These and various other objects and advantages of the invention will become readily apparent to those skilled in the art upon reading the following detailed description and claims and by referring to the accompanying drawings.

DETAILED DESCRIPTION OF THE PREFERRED EMBODIMENT

Figure 1:
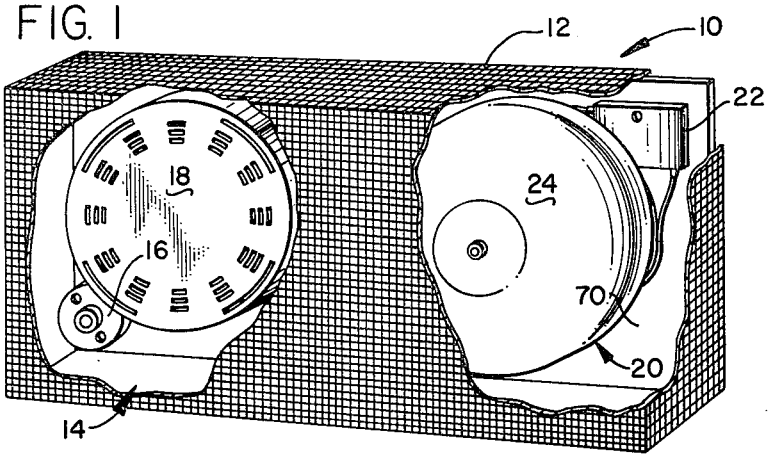
FIG. 1 is a perspective view of one form of an alarm system made in accordance with the present invention, with some parts being broken away therefrom.
Figure 2:
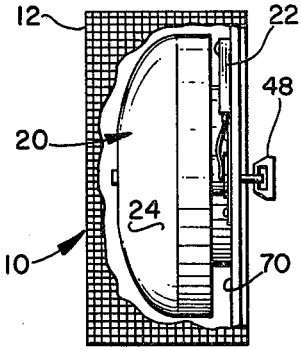
FIG. 2 is a side view of the apparatus disclosed in FIG. 1, with some parts being cut away therefrom in order to disclose the interior thereof.

In FIG. 1 there is disclosed an alarm system 10 made in accordance with the present invention. The apparatus is housed within an expanded metal enclosure 12 which forms a container having an interior 14. Enclosed within the container is a fire detector 16, smoke detector 18, and a novel alarm bell apparatus 20.

The fire detector 16 preferably actuates a switch to the closed position upon reaching a predetermined temperature, thereby imposing a source of current upon an audible alarm system as will be better appreciated later on in this disclosure. The apparatus 16 is well known and can taken on any number of forms so long as it performs this recited function. The smoke detector 18 is marketed by Sears, Roebuck & Company, Chicago, Illinois 60684 and is identified as Model T-C5841. The smoke detector includes a target containing 0.05 microcurie of RA 226, along with circuitry which interrupts current flow to a motor until the detector thereof senses the presence of smoke.

As seen in FIGS. 2–6, a rectifier 22 provides a low voltage DC supply of current for bell 20. The bell includes a centrally apertured dome 24. The dome is supported by an outwardly directed bolt 26 affixed to a spider 28, with the spider being affixed to a bell housing 30, in the illustrated manner of FIGS. 3, 4, and 6.

Figure 3:
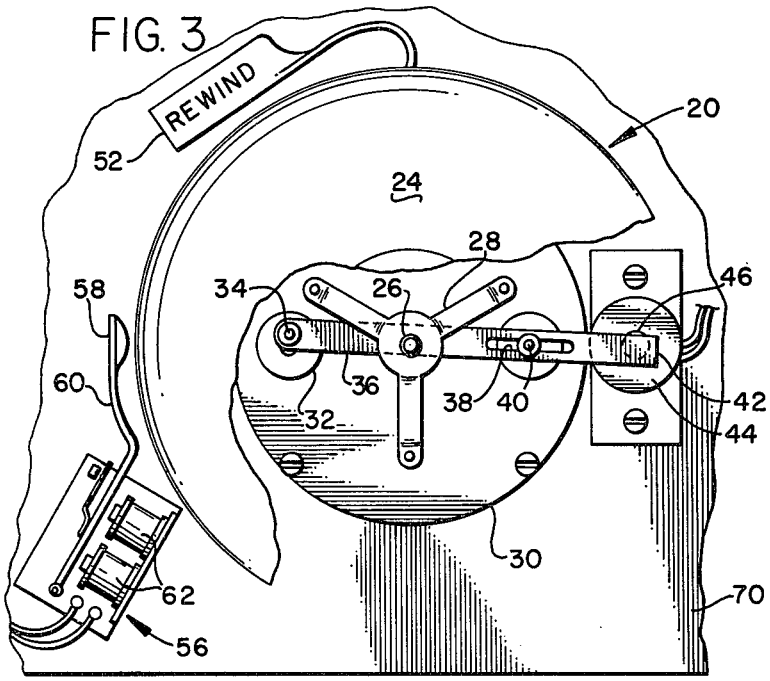
FIG. 3 is an enlarged fragmented view of part of the apparatus disclosed in the foregoing figures, with some parts being cut away therefrom to better disclose the details of the invention.
Figure 4:
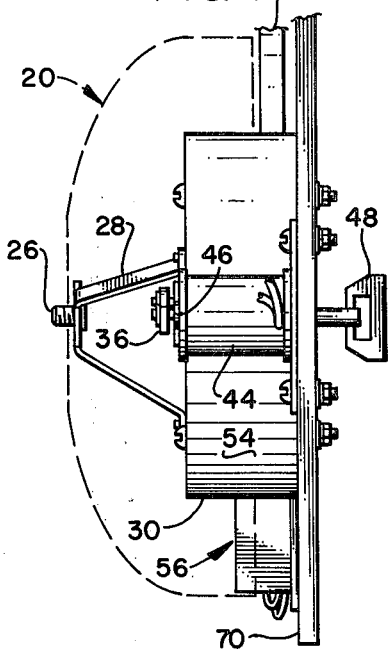
FIG. 4 is a fragmented side view of the apparatus disclosed in FIG. 3.
Figure 6:
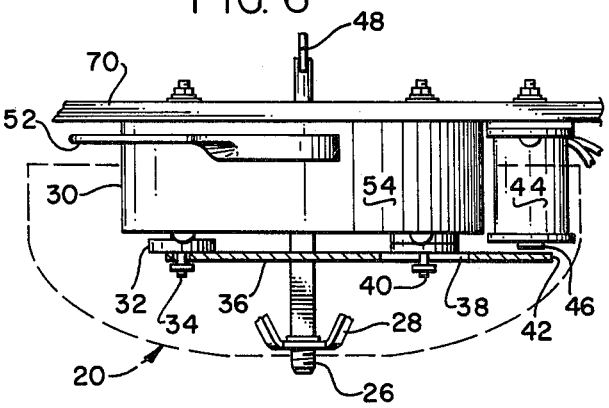
FIG. 6 is a part cross-sectional plan view of the apparatus disclosed in FIGS. 3 and 4.

As seen in FIGS. 3 and 6, a crank 32 is rotatably supported from the housing and includes an eccentric pin 34. The pin 34 reciprocatingly drives a bell clapper 36. Slot 38 is formed longitudinally of the clapper and receives guide pin 40 therethrough so that the end of the clapper 42 can strike against the inside surface of the dome.

Electromagnet coil 44 includes a core leg 46 centrally located therein for magnetically attracting a marginal end 42 of the clapper 36 when the coil is energized.

Figure 5:
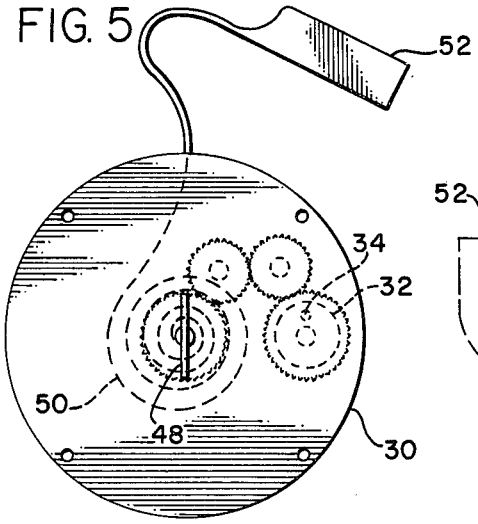
FIG. 5 is an isolated end view of part of the apparatus disclosed in FIGS. 3 and 4, with some parts being cut away therefrom.

In FIG. 5 numeral 48 indicates a key for winding a spring 50 so that energy can be stored therein. The spring 50 is connected to the illustrated gear train which leads to crank assembly 32 so that the key 48 is turned to store energy within the mechanical motor 50 to thereby enable the mechanical motor device to drive the clapper 36 in order to sound an alarm. Flag 52 is raised as the spring 50 depletes its energy signifying that the motor requires rewinding. Circumferentially extending sidewall 54 of the housing is encapsulated by the bell dome 24.

Figure 7:
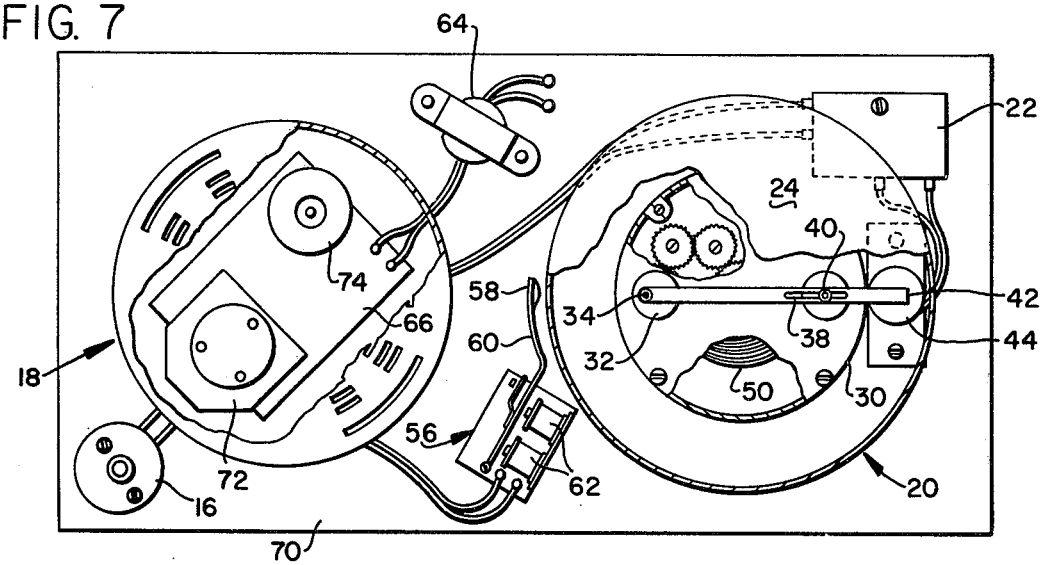
FIG. 7 is a part cross-sectional, part diagrammatical, part schematical illustration of the apparatus disclosed in FIGS. 1 and 2.
Figure 8:
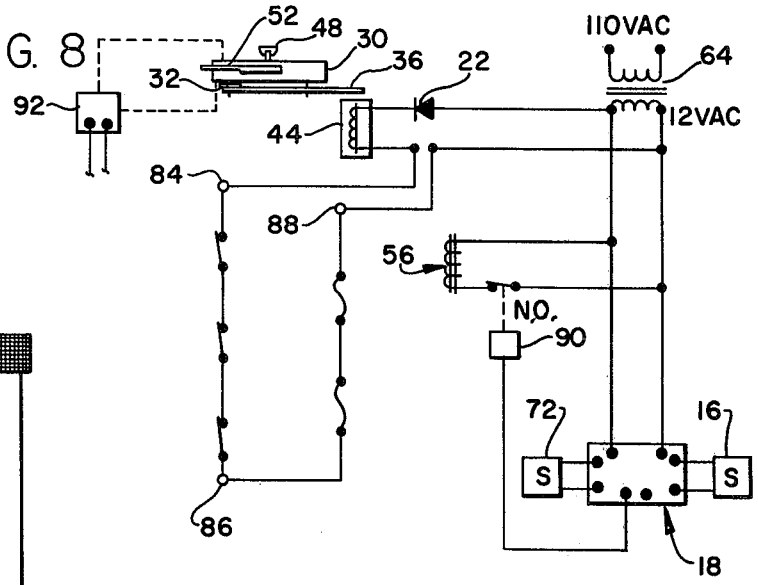
FIG. 8 is a schematical representation of circuitry used in conjunction with the apparatus of the foregoing figures.

As best seen in FIGS. 3, 7, and 8 an electric motor 56 includes a second clapper 58 placed adjacent to the dome 24 so that the motor drives the arm 60 to thereby cause a second clapper 58 to sound an alarm. The clapper motor 56 includes coils 62 which cause the second clapper at arm 60 to strike the exterior of the dome when the coils are connected to a suitable source of current.

In FIGS. 7 and 8, the step down transformer 64 reduces 110 volts domestic current supply to a suitable voltage for the circuitry contained on a printed circuitry card 6. The reduced AC voltage is also connected to the before mentioned rectifier 22 for providing the before mentioned coil 44 with a suitable low voltage DC current.

Chassis board 70 suitably supports all of the components disclosed above and forms the rear wall of the enclosure seen in FIG. 1. A smoke sensor device 72, which forms part of smoke detector apparatus 18, is connected to the circuitry 66 in the same manner as the fire detector 16 so that when either smoke or elevated temperature is encountered, a suitable source of current is supplied to the coils 62 of the motor assemble 56, thereby enabling the second clapper to sound an alarm.

In FIG. 8 a series of switches between junctions 84 and 86 are series connected to one another and to the illustrated foil strips schematically indicated between junctions 86 and 88. The switches and foil strips are series connected respective to the electromagnet 44. Smoke detector 72 and fire detector 16 are connected to circuitry 18 to cause the switch actuator 90 to close the N.O. (normally open) switch to coil 56 when there is danger of smoke or fire as evidenced by the two sensors.

Figure 9:
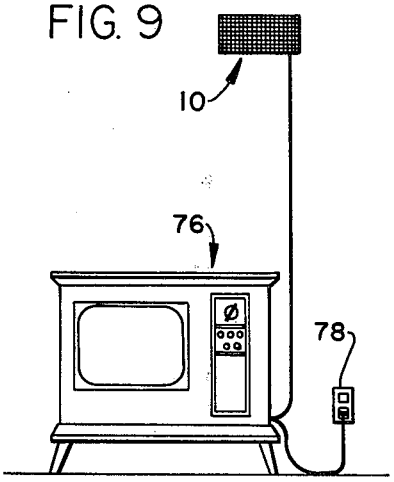
FIG. 9 is a front perspective view illustrating one use of the present invention.

In FIG. 9 a television set 76 is plugged into a conventional wall socket 78 while the invention 10 is conveniently mounted on a vertical wall of a room, as for example in a motel room. As seen in FIG. 9, the source of current for the invention 10 is taken from the interior of the television set. Accordingly, the apparatus 10 in FIG. 9 simultaneously serves several functions: fire protection, smoke protection, protection against theft of the television 76, and an alarm in the event current failure occurs.

Figure 10:
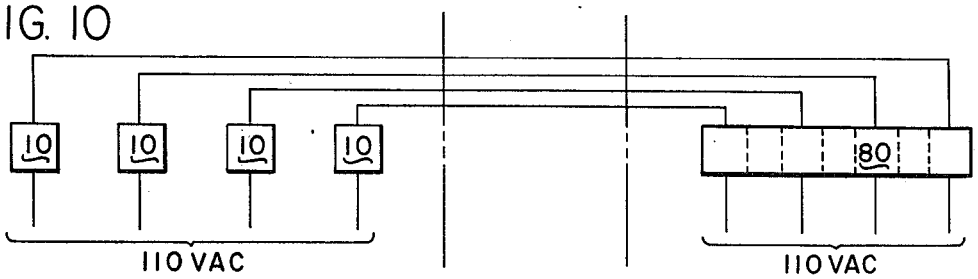
FIG. 10 is a schematical representation of another use of the present invention.

In FIG. 10, a plurality of units 10 made in accordance with the present invention, are individually mounted one within each of a plurality of motel rooms and connected to a suitable source of current as illustrated in FIG. 9, for example. Each of the units have electrical conductors leading therefrom and to a monitor box 80. The monitor box is connected to a suitable source of current, and each of the monitor boxes therefor indicate the condition of the room within which the corresponding apparatus 10 is located. Means are provided whereby energization of motor 56 or de-energization of coil 44 is evidence at 80 by visual or audible means.

In operation the apparatus 10 is placed in any convenient location, and transformer 64 is connected to a suitable 110 volt domestic household current supply. Where it is deemed desirable additional remote units 16 and 18 can be placed in several different rooms and conected back to the circuitry 66. The spring 50 is wound with the key 48, and since the clapper 36 is attracted to the core leg 46, the clapper will remain captured and therefore dormant until the circuit leading to the coil 44 is broken.

At the same time circuitry 66 prevents current flow from 64 to the motor 56 so long as no smoke is detected at 72 and so long as the temperature sensor at 16 is sufficiently low to prevent the circuitry 16 from actuating motor 56. In the event that either heat or smoke actuates circuitry 66, the motor 56 will be energized thereby causing the clapper 58 to strike the dome 24, thereby sounding the alarm.

In the event fire should break out in some remote part of the dwelling and burn the electrical wires so that no source of current is effected at 64, this action will discontinue current flow at 64, thereby de-energizing coil 44, whereupon the core leg 46 releases the clapper 36, thereby enabling the stored energy at 50 to actuate the crank assemble 32 so that the clapper 36 strikes the dome and sounds the alarm.

It is contemplated to use the motion of the rewind flag 52 to actuate a switch from the N.O. to the closed position, whereupon the switch completes the circuit to a geared motor or solenoid device for rewinding the spring 50. As the spring is rewound the switch is returned to the N.O. position thereby preventing overwinding the spring. This expedient automatically provides reset of the present combination in the event temporary power interruption should occur while no one is in proximity of the apparatus.

I claim:

1. An alarm bell having a main housing, a bell dome supported by the housing, a mechanical motor contained within the housing and having a spring means within which energy can be stored, a first clapper actuated by the spring means of the motor for repeatedly striking said dome;

a second clapper, an electric motor connected to actuate said second clapper, means positioning said second clapper such that the clapper strikes said dome when said second clapper is actuated by said electric motor; circuit means including a first switch means by which said electric motor is energized whenever an alarm is to be sounded with said second clapper;

said first clapper being an elongated, relatively flat member, an electromagnet having a coil energized by a source of current, said electromagnet being placed adjacent to said first clapper so that a flat surface of the clapper is magnetically attracted and held in fixed relationship by said electromagnet when the coil thereof is energized to thereby arrest movement of said first clapper;

a second switch means arranged to be actuated by movement of a closure means, said second switch means being connected in series with said coil of said electromagnet; said first clapper includes mount means by which said first clapper is positioned for reciprocating motion such that one end thereof strikes the dome of the bell when reciprocated;

circuit means by which current is applied through said second switch means to said electromagnet;

a smoke detector and a fire detector connected to actuate said first switch means to the closed position, thereby causing said second clapper to sound an alarm whenever smoke and fire is sensed;

whereby the presence of smoke or fire causes the second clapper to sound an alarm and the interruption of electrical power causes the first clapper to be released from said electromagnet to sound an alarm.

* * * * *